United States Patent [19]

Velleman

[11] Patent Number: 4,695,681

[45] Date of Patent: Sep. 22, 1987

[54] MEMBRANE FOR MEMBRANE SWITCHES AND COMPOSING ELEMENTS THEREOF

[75] Inventor: Koen Velleman, Gavere, Belgium

[73] Assignee: Velleman-Switch, naamloze vennootschap, Gent, Belgium

[21] Appl. No.: 863,341

[22] Filed: May 15, 1986

[30] Foreign Application Priority Data

May 22, 1985 [BE] Belgium ..... 2/60691

[51] Int. Cl.[4] ..... H01H 13/70

[52] U.S. Cl. ..... 200/5 A; 200/159 B

[58] Field of Search ..... 200/5 R, 5 A, 86 R, 200/159 B, 83 N, 263, 340, 302.1, 302.2

[56] References Cited

U.S. PATENT DOCUMENTS

| | | | |
|---|---|---|---|
| 3,042,764 | 7/1962 | Hermle | 200/302.2 X |
| 3,760,137 | 9/1973 | Shimojo et al. | 200/5 A X |
| 3,845,260 | 10/1974 | Lohr | 200/159 B X |
| 3,860,771 | 1/1975 | Lynn et al. | 200/5 A |
| 3,898,421 | 8/1975 | Suzumura | 200/5 A X |
| 4,127,752 | 11/1978 | Lowthorp | 200/5 A |
| 4,127,758 | 11/1978 | Lowthorp | 200/5 A X |
| 4,194,097 | 3/1980 | Bradam | 200/5 A |
| 4,245,138 | 1/1981 | Harper | 200/5 A |
| 4,322,587 | 3/1982 | Burns et al. | 200/302.1 X |

FOREIGN PATENT DOCUMENTS

| | | | |
|---|---|---|---|
| 1361459 | 7/1974 | United Kingdom | 200/159 B |

*Primary Examiner*—J. R. Scott

*Attorney, Agent, or Firm*—Schwartz, Jeffery, Schwaab, Mack, Blumenthal & Evans

[57] ABSTRACT

Membrane for membrane switches and composing elements thereof, characterized thereby that it mainly consists of a profiled top layer (2) made of a resilient material and of an underlying supporting layer (1) that is provided with an opening (3), the top layer (2) having a recess fitting in the opening (3) and consisting of sidewalls (5) and a part suspended therebetween having the shape of a spherical segment constituting the membrane (6) proper.

13 Claims, 4 Drawing Figures

MEMBRANE FOR MEMBRANE SWITCHES AND COMPOSING ELEMENTS THEREOF

BACKGROUND OF THE INVENTION

1. Field of the Invention

This invention relates to a membrane for membrane switches as well as to the elements thereof, in other words to a membrane that can touch switching contacts in such a way that when the latter are depressed, an electrical contact is made. Herein the switching contacts can be provided at the membrane itself as well as underneath it in the form of a pressure contact switch.

More especially a membrane is concerned which can be used in control panels with push-button operation, in which the construction of the membrane can be either single or multiple. In the latter case the membranes of the various switches form one continuous profiled layer.

Obviously, the invention also relates to any membrane-operated switches wherein a membrane according to the present invention is used.

2. Related Art

Such membrane switches are well-known and are characterized by the membrane which at its edges is rigidly fixed and can be depressed in its centre so as to realize an electrical contact. In general they offer the advantage of being simple and light-weight. The simplicity is based on the fact that no mechanical screw connections and/or clamp connections are required for securing the various parts with respect to one another, as such membrane switch mostly consists of parts glued together. Such a construction wherein the various parts are glued together also offers the advantage of being perfectly waterproof. This is especially advantageous upon using control panels in humid operation circumstances.

However, all the known types have the disadvantage that the membrane starts to tear after some time, whereby on the one hand the proper functioning of the membrane switch is prejudiced, and on the other hand it may not be waterproof any longer, which may be hazardous for the operator.

Tearing of the known membranes is mainly the result of their shape, their fixation and of the possibility of actuating them off their centre.

SUMMARY OF THE INVENTION

In order to eliminate this disadvantage the present invention provides a membrane for membrane switches as well as the elements thereof, wherein the membrane practically cannot tear and has a very long service life. Therefore, the construction of the membrane is such that it is practically impossible to exert a pressure on it at the wrong place. This is due to the finger-seeking action of the membrane according to the present invention, whereby the finger pressure is always transferred to the centre of the membrane.

The membrane according to the present invention offers the advantage that its construction can be very light-weight as the risk of tearing by actuation at the wrong place is minimal. So, with membranes of this type it is possible to make membrane switches that on the one hand require but a finger-tip energizing and on the other hand have a long service life.

The membrane for membrane switches according to the present invention having the aforesaid and other advantages, therefore consists mainly of a profiled top layer 2 made of a resilient material and an underlying supporting layer 1 provided with an opening 3, the top layer 2 having a recess fitting in the opening 3 and consisting of side-walls 5 and a part hanging therebetween and having the shape of a spherical segment forming the proper membrane 6.

BRIEF DESCRIPTION OF THE DRAWINGS

In view of better showing the features of the present invention, a preferred embodiment of the membrane and of its composing elements as well as a membrane switch made with it are described without limiting the scope of the present invention with reference to the accompanying drawings, wherein.

DETAILED DESCRIPTION OF THE PREFERRED EMBODIMENT

Figure 1:
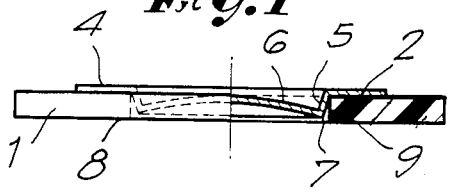
FIG. 1 represents a partial section of a sideview of the membrane according to the present invention.
Figure 2:
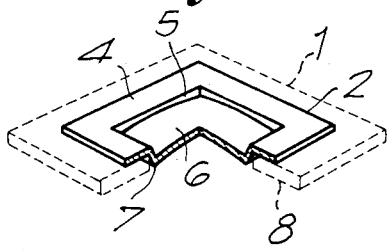
FIG. 2 represents a perspective view of the embodiment of FIG. 1.

In a preferred embodiment as represented in FIGS. 1 and 2, the membrane according to the present invention mainly consists of two layers glued together, viz. a supporting layer 1 and a profiled top layer 2 applied thereto.

In the represented embodiment the supporting layer 1 consists of a sheet of, e.g., 1.5 mm thickness made of an electrically insulating or isolating material such as, e.g., plastic, wherein an opening 3 of about 1.5cm×1.5 cm has been provided.

The top layer 2, which is specifically represented in FIG. 2, consists of a relatively flexible, profiled material having a thickness of, e.g., about 0.25 mm. It consists of a flat part 4 of folded down rims or side-walls 5 and of a spherical part applied between the walls 5 and constituting the membrane 6 proper.

The form and the size of the profile formed by the side-walls 5 and the membrane 6 correspond with those of the opening 3 in the supporting layer 1. The top layer 2 is fixed to the supporting layer 1, e.g. by means of an adhesive, in such a way that the profile formed by the side-walls 5 and the membrane 6 is just in the opening 3 of the supporting layer 1, so that the membrane 6 is suspended as it were to said side-walls 5. The edge 7 of the membrane 6, or in other words the junction of the membrane 6 and the side-walls 5, is not lower than the bottom side 8 of the supporting layer 1, but finds itself at a very small distance above it.

As the edge 7 the side-walls 5 have a certain clearance with respect to the inner wall 9 of opening 3 in the supporting layer 1 so that the side-walls 5 can more freely when the membrane 6 expands or is deformed when being energized.

For elucidating the use and the application of the membrane, a membrane switch is described hereinafter which is equipped with the membrane.

Figure 3:
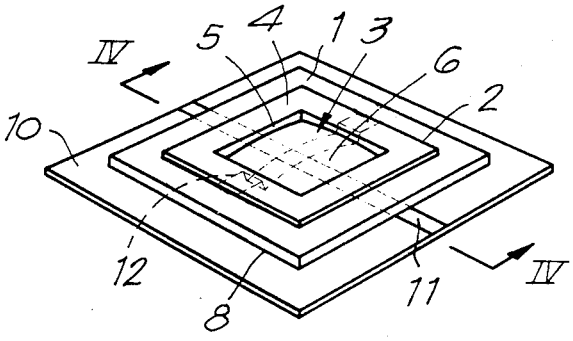
FIG. 3 represents a membrane switch wherein the membrane according to FIG. 1 has been used.
Figure 4:
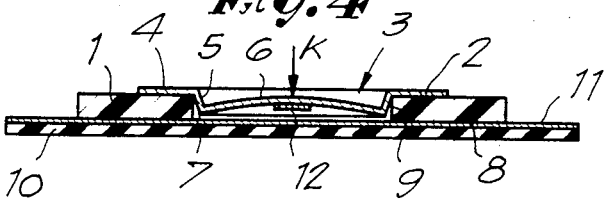
FIG. 4 represents a section according to line IV—IV in FIG. 3.

As represented in FIGS. 3 and 4, the membrane switch according to the present invention mainly consists, at the one hand, of three layers preferably glued together, viz. an under-layer 10 and the aforementioned supporting layer 1 and top layer 2, and, on the other hand, of two electrical contact elements 11 and 12.

The under-layer 10 consists of a flat sheet to which the contact element 11 has been applied in the form of an electrically conductive strip. As the under-layer 10 constitutes the basis for taking up the pressure forces on the proper membrane 6 when the switch is operated, it is made, of course, either of a sufficiently strong material or of a foil that is secured to a solid base.

To the under-layer 10—and the contact element 11—the supporting layer 1 and the top layer 2 are applied, such as they are represented in FIG. 1, e.g. by means of a glue.

The second contact element 12 is provided at the underside of the top layer 2 and so runs the entire underside of the membrane 6 proper. Each of both contact elements 11 and 12 consists of a stratum of silver, graphite, a mixture of both or any other suitable material, which is applied to the under-layer 10 and the underside of said top layer 2 by means of any process suited for that purpose. Naturally, the contact point of both contact elements 11 and 12 is in the centre of opening 3 of said supporting layer 1.

The operation can be simply deduced from the figures and the above description. By depressing the spherical part of the membrane 6 proper, the latter is deformed and the contact elements 11 and 12 come into contact with each other and form an electrical contact. The expansion and the deformation of membrane 6 for the major part is taken up by the side-walls 5 as they can move laterally.

Since one has to exert the pressure force K with the finger in opening 3 of the supporting layer 1 and since this opening 3 has a diameter equalling that of a finger top, said force will practically always be exerted centrally on membrane 6.

The membrane 6 being depressed, it partly bends with a click just before contact is made. This offers the interesting effect that the person operating the switch feels and hears that contact is being realized.

Obviously, the membrane 6 should only be at a small distance above the under-layer 10 such that it cannot completely bend and that upon being released it comes back in its non-contact position. The force K to be exerted thereby is proportional to the thickness of the material of the top layer 2 as well as to the curvature of the membrane 6.

It is also obvious that many variants or embodiments of the present invention are possible and that the above dimensions have no limitative character whatever.

So, e.g., the opening 3 in the supporting layer 1 and the corresponding profile of the membrane 6 proper may have any shape and be rectangular, pentagonal, hexagonal or circular or yet have some other shape. If opening 3 is polygonal, the angles are preferably rounded off.

Upon assembling the membrane switch according to the present invention the different components, of course, can be connected with each other in various ways, e.g. by keeping them clamped together by means of a fixture not represented in the figures. But preferably, however, a double-face sticking supporting layer is used, which, e.g., is first applied to the under-layer 10 and to which the top layer 2 is adhered afterwards.

According to a variant, the contact elements 11 and 12 consist of thin metal strips that are stuck to the under-layer 10 and the top layer 2 respectively. Self-evidently, the under-layer 10 may consist of a conductive material, whereby it is not necessary any longer that a separate contact element 11 be used.

According to a variant, a plurality of such a membrane switch or the membrane itself can be provided very simply on a control panel. In that case the three layers 1, 2 and 10 are larger, wherein the supporting layer 1 but also top layer 2 have many openings 3, which top layer possesses as many profilings and spherical segments or membranes 6.

The under-layer 10 as well as both contact elements 11–12 can also be replaced by switching elements known by themselves, the construction formed by the supporting layer 1 and the top layer 2 then taking care of a proper sealing.

According to a variant, two contact elements are provided at the under-layer 10, all this such that the contct element 12 upon depression of the membrane 6 establishes a junction between both first elements. The contact strips used herein can have any form.

In the supporting layer 1 and/or the under-layer 10 preferably openings are provided for allowing the air under the membrane 6 to escape when the latter is being depressed.

Evidently, the top layer 2 can be provided with all kinds of inscriptions and indications. If the top layer 2 is transparent or translucent, such an inscription can also be provided at the underside of said membrane 6.

From the description it is obvious that the membrane according to the present invention and the composing elements thereof as well as the membrane switch assembled therewith possess all the abovementioned advantages.

The present invention is by no means limited to the embodiment represented in the accompanying drawings and described by way of an example, but such membrane as well as its composing parts can be realized in any shape and dimensions without exceeding the scope of the present invention.

I claim:

1. A membrane for use with membranes switches, comprising:

(a) a profiled top layer of resilient material;

(b) an underlying supporting layer having an upper surface, an underside and an opening therein; and (c) said top layer being positioned on said upper surface of said underlayer and having a recess fitted in said opening, said recess formed by sidewall means extending downwardly into said opening and a spherical segment extending upwardly into said opening and being suspended from an edge formed by a junction between said sidewall means and said spherical segment.

2. The membrane according to claim 1, characterized thereby that said edge is at a very small distance above the underside of said supporting layer and that there is clearance between said side-walls and an inner wall of said opening.

3. The membrane according to claim 1, characterized thereby that said opening is substantially rectangular.

4. The membrane according to claim 1 characterized thereby that said opening is substantially circular.

5. The membrane according to claim 1 characterized thereby that said profiled top layer is glued to said supporting layer.

6. The membrane according to claim 1, wherein said resilient material is plastic having a thickness of about 0.25 mm.

7. A membrane comprising: an element of resilient material having a generally flat portion and a recess formed therein, said recess being formed by a plurality of sidewalls extending in a first downward direction to an edge forming a junction between said sidewalls and a spherical segment, said spherical segment extending in a second upward direction from said edge.

8. The membrane according to claim 7 wherein said sidewalls extend in an angled, inward direction.

9. The membrane according to claim 7, wherein said resilient material is plastic having a thickness of about 0.25 mm.

10. A membrane switch comprising:

(a) a profiled top membrane layer of resilient material;

(b) a underlying supporting layer having an upper surface, an underside and an opening therein;

(c) said top layer being positioned on said upper surface of said underlayer and having a recess fitted in said opening, said recess formed by sidewall means extending downwardly into said opening and a spherical segment extending upwardly into said opening and being suspended from an edge formed by a junction between said sidewall means and said spherical segment;

(d) an under-layer supporting said underlying layer; and (e) cooperating electrical contact elements on said under-layer and on said spherical segment.

11. A membrane switch according to claim 10, characterized thereby that said edge is at a very small distance above the underside of said supporting layer and that there is clearance between said side-walls and an inner wall of said opening.

12. A membrane switch according to claim 10, characterized thereby that said profiled top layer is glued to said supporting layer.

13. A membrane switch according to claim 10, wherein said resilient material is plastic having a thickness of about 0.25 mm.

* * * * *